US010101028B2

(12) United States Patent
Loveless et al.

(10) Patent No.: US 10,101,028 B2
(45) Date of Patent: Oct. 16, 2018

(54) INLINE PILOT WITH FLAME DETECTION DEVICE AND METHOD THEREOF

(71) Applicant: Profire Energy, Inc., Lindon, UT (US)

(72) Inventors: Mark R. Loveless, Mapleton, UT (US); Melvin Hal Parks, Pleasant Grove, UT (US); Justin W Hatch, Spanish Fork, UT (US); Stephen N. Pitcher, Alpine, UT (US)

(73) Assignee: PROFIRE ENERGY, INC., Lindon, UT (US)

( * ) Notice: Subject to any disclaimer, the term of this patent is extended or adjusted under 35 U.S.C. 154(b) by 384 days.

(21) Appl. No.: 14/997,200

(22) Filed: Jan. 15, 2016

(65) Prior Publication Data

US 2016/0209032 A1 Jul. 21, 2016

Related U.S. Application Data

(60) Provisional application No. 62/104,809, filed on Jan. 18, 2015.

(51) Int. Cl.

| | |
|---|---|
| ***F23Q 9/00*** | (2006.01) |
| ***F23N 5/02*** | (2006.01) |
| ***F23N 5/12*** | (2006.01) |
| ***F23D 14/08*** | (2006.01) |

(52) U.S. Cl.

CPC ..... *F23Q 9/00* (2013.01); *F23D 14/08* (2013.01); *F23N 5/02* (2013.01); *F23N 5/12* (2013.01); *F23D 2207/00* (2013.01)

(58) Field of Classification Search

CPC ..... F23Q 9/00; F23N 5/02; F23N 5/12; F23D 2207/00; F23D 14/08

See application file for complete search history.

(56) References Cited

U.S. PATENT DOCUMENTS

| | | | | |
|---|---|---|---|---|
| 3,814,634 A * | 6/1974 | Burket | F23Q 9/00 | 136/218 |
| 5,927,963 A * | 7/1999 | Wolcott | F23N 5/20 | 431/264 |
| 2013/0330675 A1* | 12/2013 | Strong | F23N 5/123 | 431/6 |

* cited by examiner

*Primary Examiner* — Alfred Basichas

(74) *Attorney, Agent, or Firm* — Stoel Rives, LLP

(57) ABSTRACT

A novel inline pilot assembly and method of flame detection for use with combustion applications for oil or gas processing is provided wherein the pilot assembly includes a pilot novel assembly with a unique placement of fuel and induction holes to improve flame stability, promote flame anchoring near the diffuser, and discourage the pilot flame front from migrating forward away from the diffuser.

14 Claims, 13 Drawing Sheets

INLINE PILOT WITH FLAME DETECTION DEVICE AND METHOD THEREOF

PRIORITY

The present application claims the benefit of U.S. Provisional Patent Application Ser. No. 62/104,809 filed on Jan. 18, 2015, which is incorporated herein by reference in its entirety.

THE FIELD OF THE INVENTION

The present invention relates to pilots having a flame detection device and methods for flame detection. More specifically, the present invention relates to a naturally aspirated inline pilot having a flame detection device for combustion applications for oil and gas processing and a novel method of flame detection using novel near field ionization flame detection.

BACKGROUND

Pilots are commonly used for combustion applications for oil and gas processing, including burner management systems, flare stacks, process vessels, separators, boilers, line heaters and other burner applications for oil and gas processing. These pilots typically serve as an ignition source for a larger primary gas burner.

Pilot operation is critical because it impacts the efficiency, effectiveness, and safety of a burner application. Thus, monitoring the pilot flame to ensure flame presence and optimization may be crucial to effective operation of a combustion application for oil and gas processing. A flame supervision device may be used to monitor a pilot flame and control fuel flow and pilot ignition to prevent gas from flowing to the pilot if the flame is extinguished. A flame supervision device can be used to prevent dangerous unrestricted flow of gas without proper combustion. It may also be used for optimizing the pilot flame.

Flame rectification is a common method of flame detection used for burner applications at oil and gas well sites. In flame rectification, a flame sensor (flame rod or element) is configured so it may make contact with a pilot or burner flame. An alternating current is applied to the sensor so that when a flame is present the current flows from the sensor through the flame to a ground. When the surface area of one probe, such as a flame rod, is made smaller than that of the other probe, such as the ground, current tends to flow more in one direction, from the smaller surface to the larger one. Current can only flow when a flame is present, to conduct the ions through the ionized hot gas. Because the flame rod or sensor is smaller than the ground electrode, an alternating current (AC) applied to the flame sensor flows primarily in one direction and the AC current is rectified to a pulsating direct current (DC), or rectified current. This current can be used to signal a control module that a flame is present when a DC signal from the flame rod is present. Flame rectification relies on ionized gas formed during combustion, which may carry a small current.

Flame rectification systems for pilots commonly available in the industry typically include a flame sensor rod and a ground where the flame sensor rod is configured externally to a pilot nozzle and the ground may comprise the pilot nozzle or a separate ground electrode configured externally to the pilot nozzle. One of the challenges with flame rectification systems currently used in the industry is low accuracy or sensitivity when detecting flames in harsh environmental conditions or under low combustion conditions.

Also, pilot failures frequently occur in existing pilot systems due to improperly adjusted or loose externally mounted ignition and flame rods that are subjected to extremes in temperature and vibration. Wind and other environmental factors can shift the flame away from the flames' sensor rod or nozzle to prevent efficient flame detection and may also extinguish the flame. Also, within enclosed combustion applications, difficult environments inside of the firing enclosure can cause the pilot flame to be diverted away from the flame sensing rod causing premature shutdown, or may be extinguished altogether.

Some attempts have been made to address these issues. However, these attempts have been inadequate and pilot systems currently available in the industry may prematurely shut down when fuel pressure is low due to adverse environmental events such as icing or clogging and thus may be less reliable under adverse environmental conditions. Moreover, pilot systems attempting to overcome these issues are very expensive and the majority of pilots used in the industry continue to include externally configured flame sensor electrodes and ground electrodes.

It is thus desirable to have a pilot assembly, system, and method thereof for oil and gas processing that provides more robust flame detection and a more robust and durable flame under various operating conditions.

SUMMARY OF THE INVENTION

In accordance with one or more aspects of the present invention, an improved pilot system and method for flame detection and maintenance is provided. In accordance with one or more aspects of the present invention, an improved method of flame in a naturally aspirated pilot system is also provided.

According to one aspect of the invention, an inline pilot assembly is provided wherein the pilot assembly is configured to support spark, combustion, and flame detection all internally to a pilot nozzle assembly. In accordance with another aspect of the invention, a flame-sensing electrode may be disposed coaxially within the pilot assembly. In yet another aspect of the invention, fuel may travel parallel and radially adjacent to the coaxially disposed electrode. Pilot ignition may be initiated using spark between the coaxially disposed flame electrode and a diffuser or a set-screw connected to the diffuser within the nozzle assembly. In another aspect of the present invention, the ignition electrode and the flame detection electrode are integrated or combined in a single rod.

In accordance with another aspect of the present invention, a novel near field ionization method of flame detection is provided including a plurality of parallel tubular-shaped flames combusting in a perimeter around and parallel to the coaxially disposed flame sensor electrode within the pilot nozzle. (As used herein, near field ionization refers to rich ionization fields near the surface of the flames.) Each of parallel tubular-shaped flames may include an ion rich surface or shell. The plurality of parallel tubular-shaped flames may be disposed so that the ion rich shell of each tubular-shaped flame may longitudinally maintain contact along the length between each tubular-shaped flame and the coaxially disposed flame sensor electrode while concomitantly being able to longitudinally maintain contact along the length between each tubular-shaped flame and the inside surface of the pilot nozzle. The plurality of tubular-shaped flames disposed longitudinally between the coaxially disposed flame sensor electrode and the inside surface of the pilot nozzle provides improved contact of flame ions for robust flame detection. In a preferred embodiment, the number of parallel tubular-shaped flames may comprise at least six flames.

Contact of the ion rich shell of one or more of the plurality of parallel tubular-shaped flames concomitantly with the coaxially disposed flame sensor electrode and with the inside surface of the pilot nozzle, where the pilot nozzle acts as a ground, may provide a closed circuit. In accordance with another aspect of the present invention, voltage shifts associated with the varying contacts between the plurality of parallel tubular-shaped flames, the coaxially disposed flame sensor electrode, and the inside surface of the pilot nozzle may be measured and used to control optimal fuel flow.

In an aspect of the present invention, the method of flame detection may comprise providing an inline pilot having a flame rod extending coaxially through the center of the inline pilot and extending coaxially through a diffuser and into a pilot nozzle, wherein the pilot nozzle is a ground; combusting a plurality of flames around a perimeter of the flame rod so that an outer ion rich shell of the plurality of flames may concurrently contact the flame rod and an inside surface of the pilot nozzle; running a current to the flame rod; and monitoring the current between the flame rod and the pilot nozzle. The method of flame detection may include providing a spark screw connected to a top surface of the diffuser within the nozzle and selectively providing current into the flame rod sufficient to create a spark between the flame rod and the spark screw in response to feedback received from monitoring the current between the flame rod and the nozzle.

In another aspect of the present invention, a method of igniting a pilot may be provided wherein the method of igniting the pilot comprises providing a pilot having a coaxially disposed flame rod extending through the center of a nozzle assembly having a pilot diffuser with a spark screw connected thereto extending above the axial surface of the pilot diffuser, wherein the pilot diffuser is grounded and contact between the flame rod and the pilot diffuser is insulated to prevent closing a circuit by direct contact between the pilot diffuser and the flame rod; delivering fuel into the nozzle assembly; and delivering sufficient current into the flame rod to create a spark between the flame rod and the spark screw. The method of igniting a pilot may selectively providing current into the flame rod sufficient to create a spark between the flame rod and the spark screw in response to feedback received from monitoring the current between the flame rod and a pilot or burner nozzle.

In accordance with another aspect of the present invention, the inline pilot may include a novel nozzle assembly comprising a unique nozzle and diffuser configured to permit anchoring of a pilot flame adjacent to the diffuser. The nozzle assembly may be configured to stabilize the pilot flame and prevent a flame front from moving forward away from the diffuser. In another aspect of the present invention, the nozzle assembly may be configured to draw in additional combustion air through a novel induction hole in response to negative pressure created as a flame front moves forward thus improving flame anchoring at the diffuser face by allowing combustion in regions of higher aerodynamic strain. In another aspect of the present invention, the diffuser is configured for improved flame durability and anchoring. In yet another aspect of the present invention, the nozzle is configured for improved flame durability and anchoring.

A pilot nozzle assembly may comprise a pilot nozzle, wherein the pilot nozzle includes a plurality of a longitudinal series of holes disposed radially in the pilot nozzle, wherein a first hole of each longitudinal series of holes is disposed near a base end of the pilot nozzle and is larger than downstream holes in the same longitudinal series of holes; a pilot diffuser disposed in the base end of the pilot nozzle, wherein a radial channel is formed between an outer radial wall of the pilot diffuser and an inner radial surface of the pilot nozzle; a plurality of radial holes disposed in the radial wall of the pilot diffuser adjacent to the radial channel; a plurality of axial holes disposed in a downstream end of the pilot diffuser adjacent a perimeter of the downstream end of the pilot diffuser; wherein the axial holes in the pilot diffuser are larger than the radial holes in the pilot diffuser and the radial holes in the pilot diffuser are not in line with the axial holes in the pilot diffuser; and wherein each first hole of each longitudinal series of holes in the pilot nozzle faze an area of the radial wall of the pilot diffuser between two of the radial holes in the pilot diffuser.

These and other novel aspects of the present invention are realized in naturally aspirated pilot assembly, apparatus, components, method of flame detection, and method of flame maintenance as shown and described in the following figures and related description. Additional novel features and advantages of the invention will be set forth in the detailed description which follows, taken in conjunction with the accompanying drawings, which together illustrate by way of example, the features of the invention.

BRIEF DESCRIPTION OF THE DRAWINGS

Various embodiments of the present invention are shown and described in reference to the numbered drawings wherein.

Figure 7B:
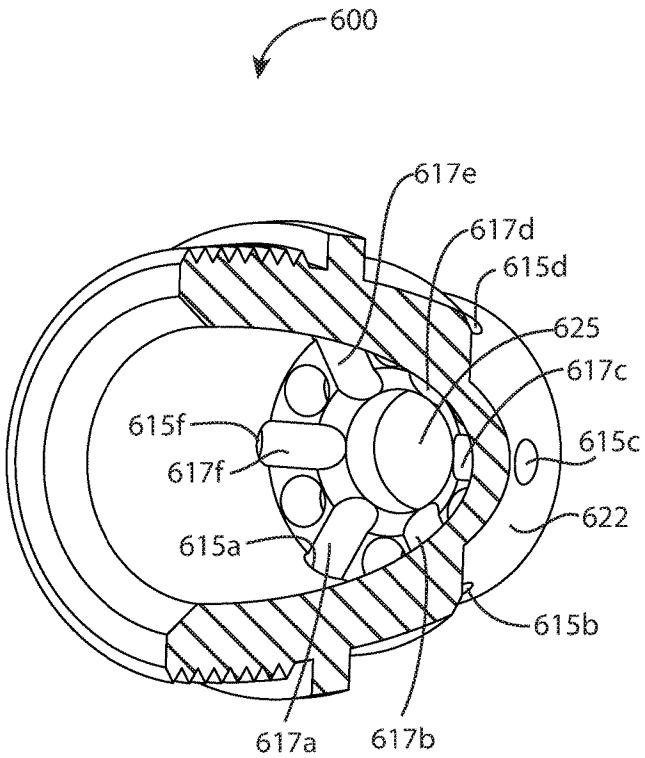
Figure 7A:
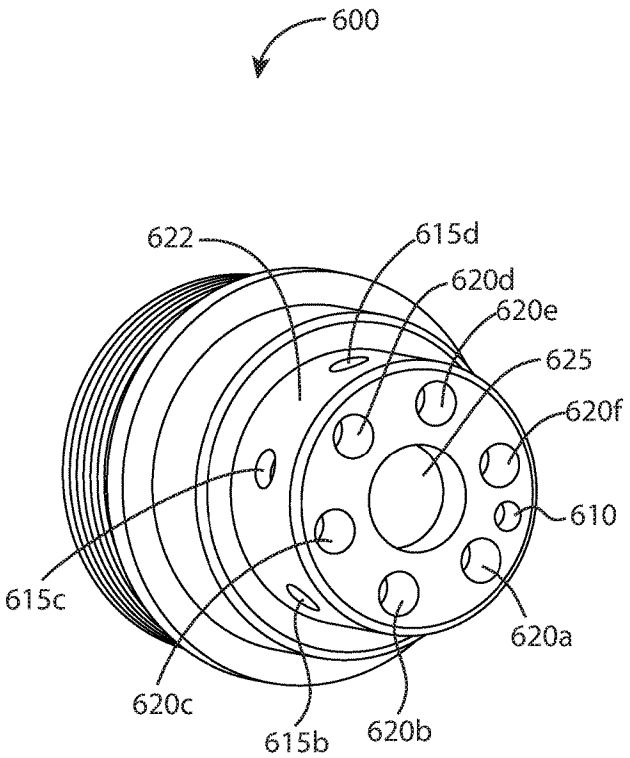
Figure 8:
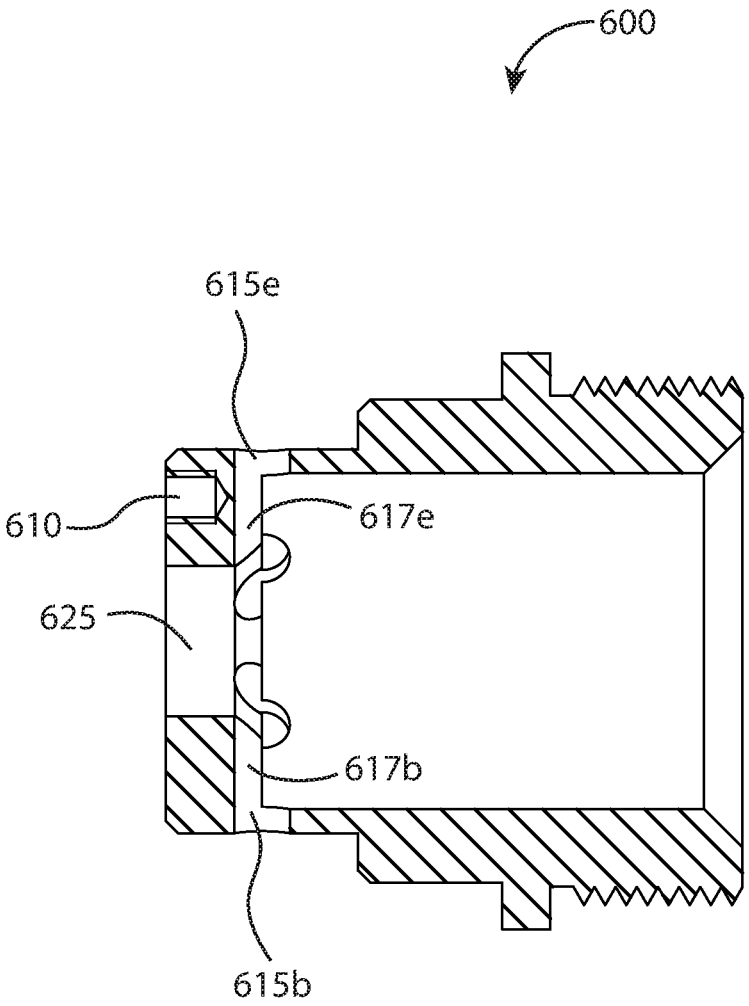
Figure 9:
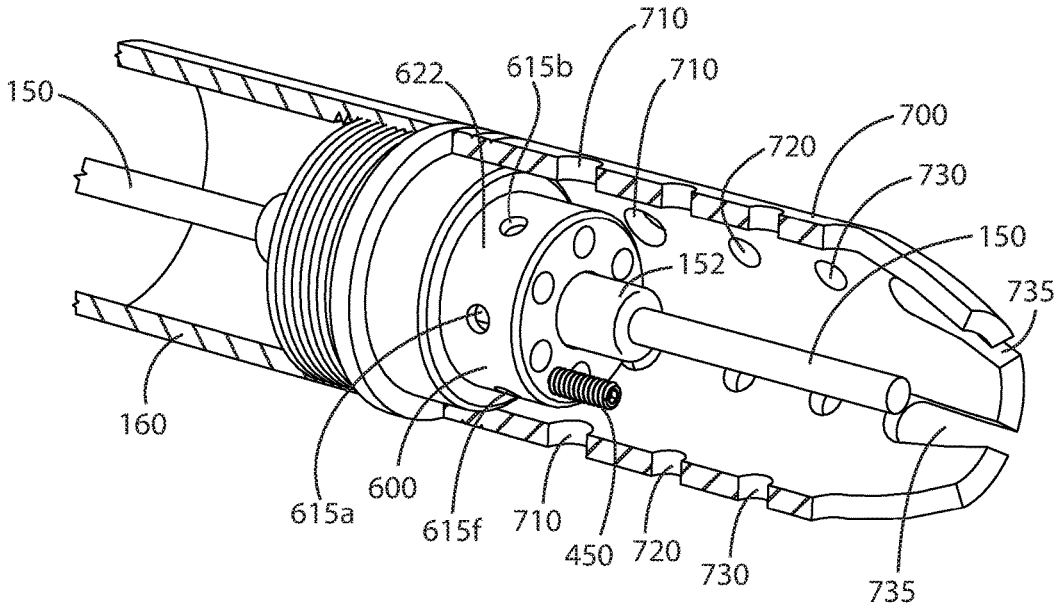
Figure 10:
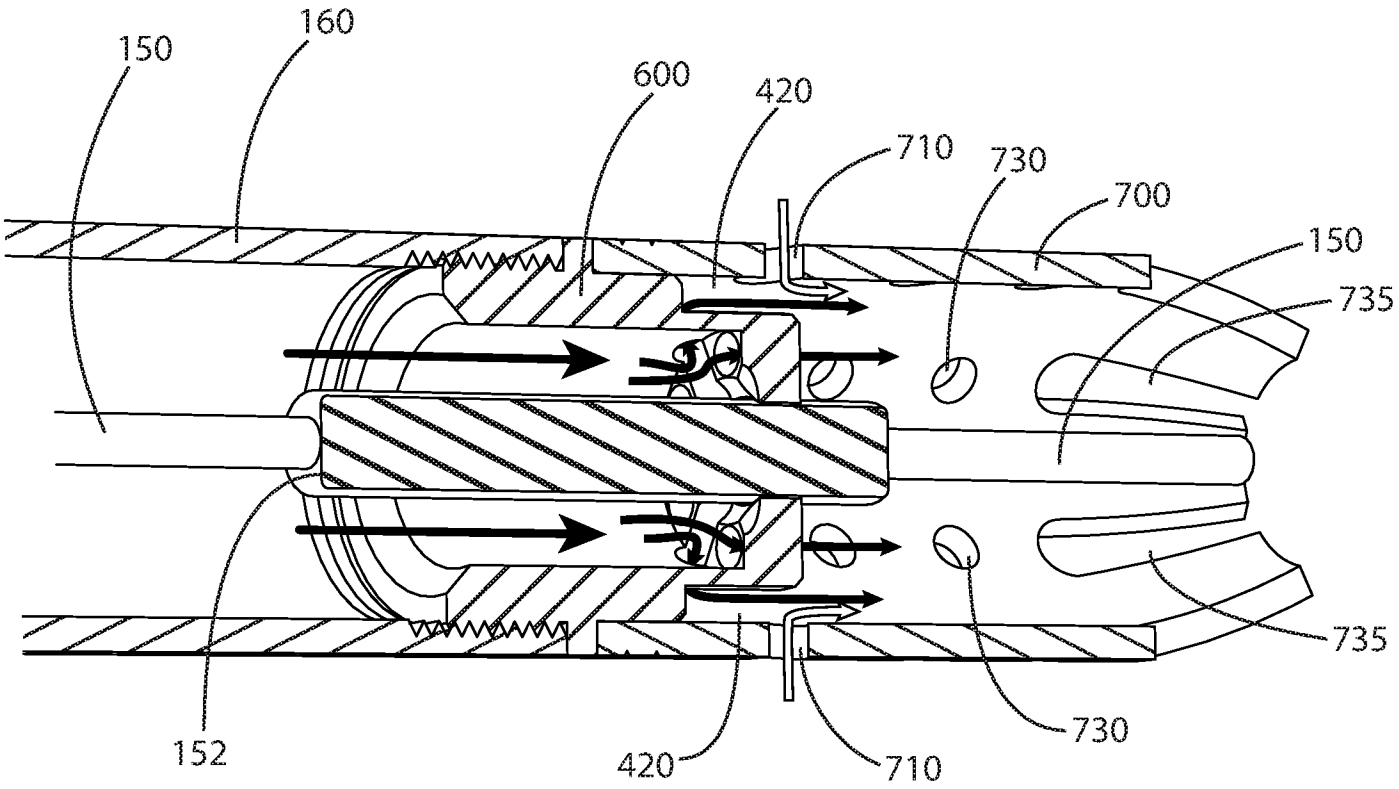
Figure 11:
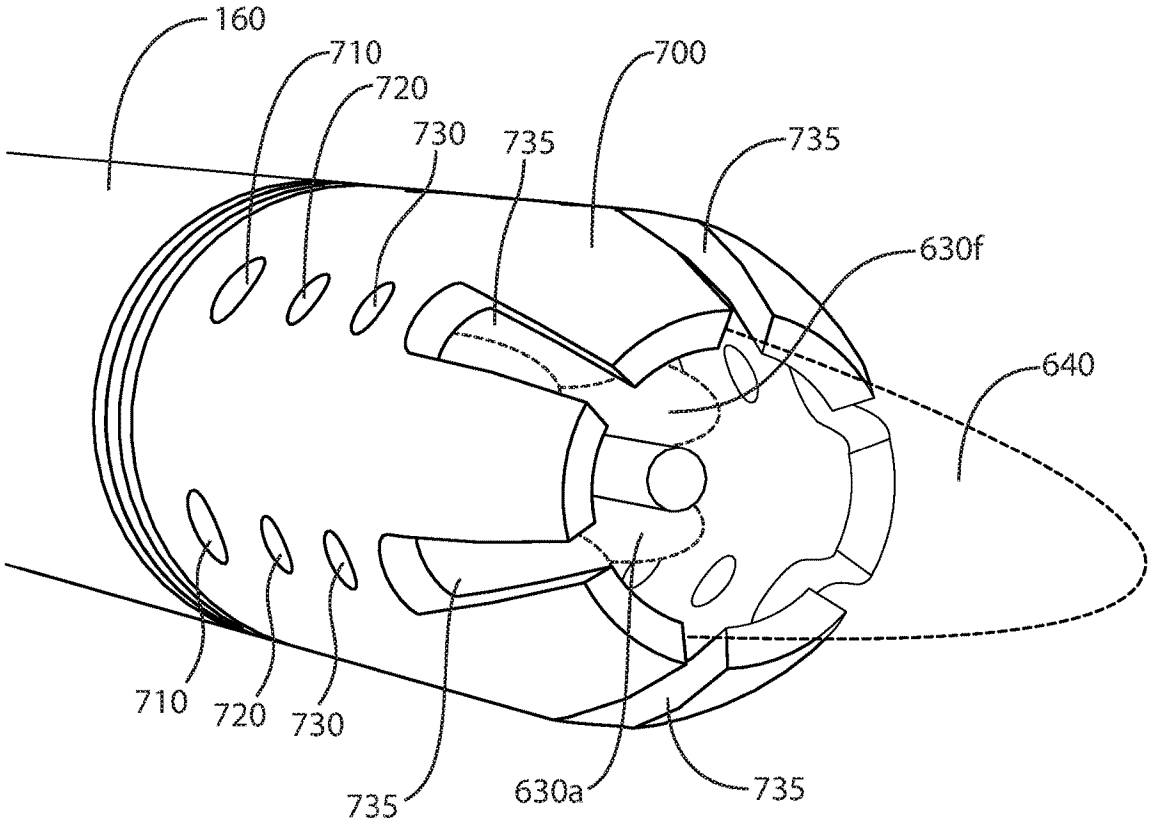
Figure 12:
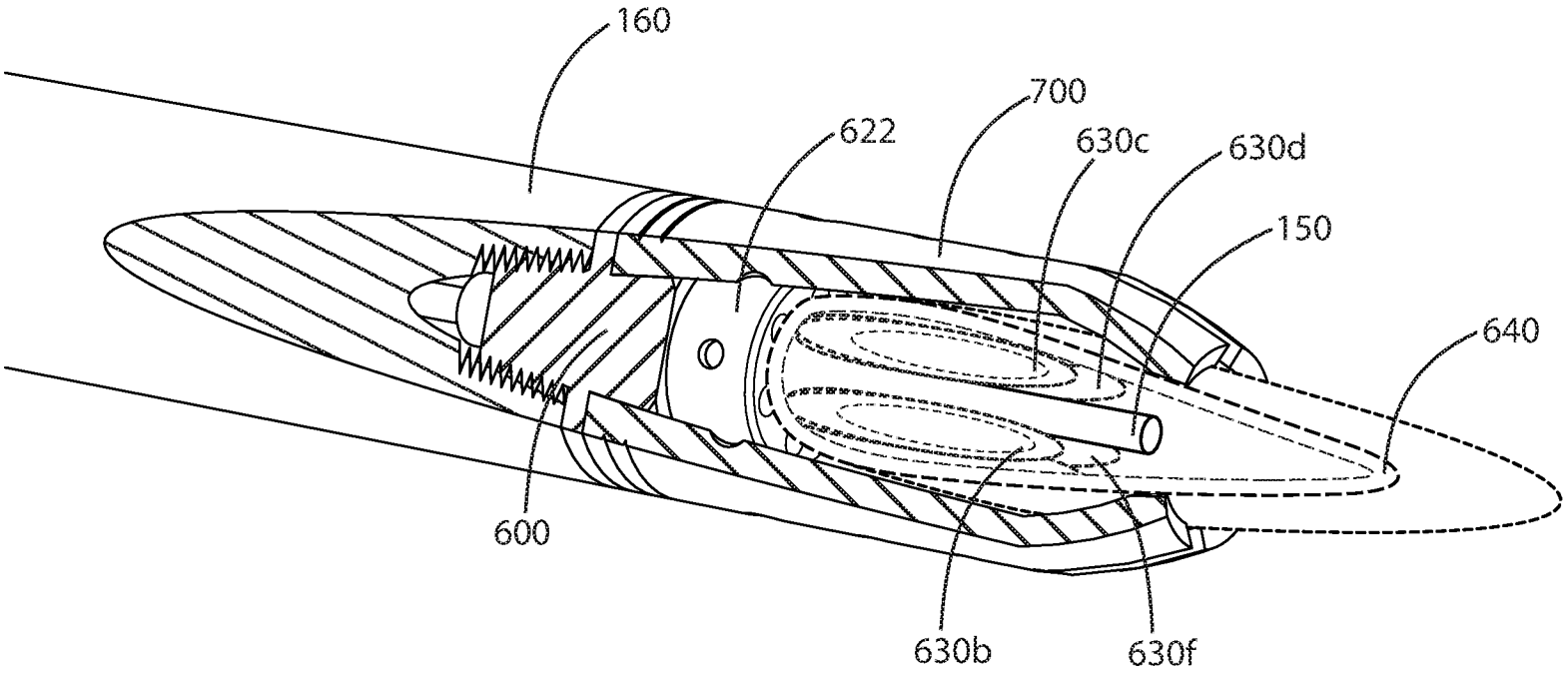
Figure 13:
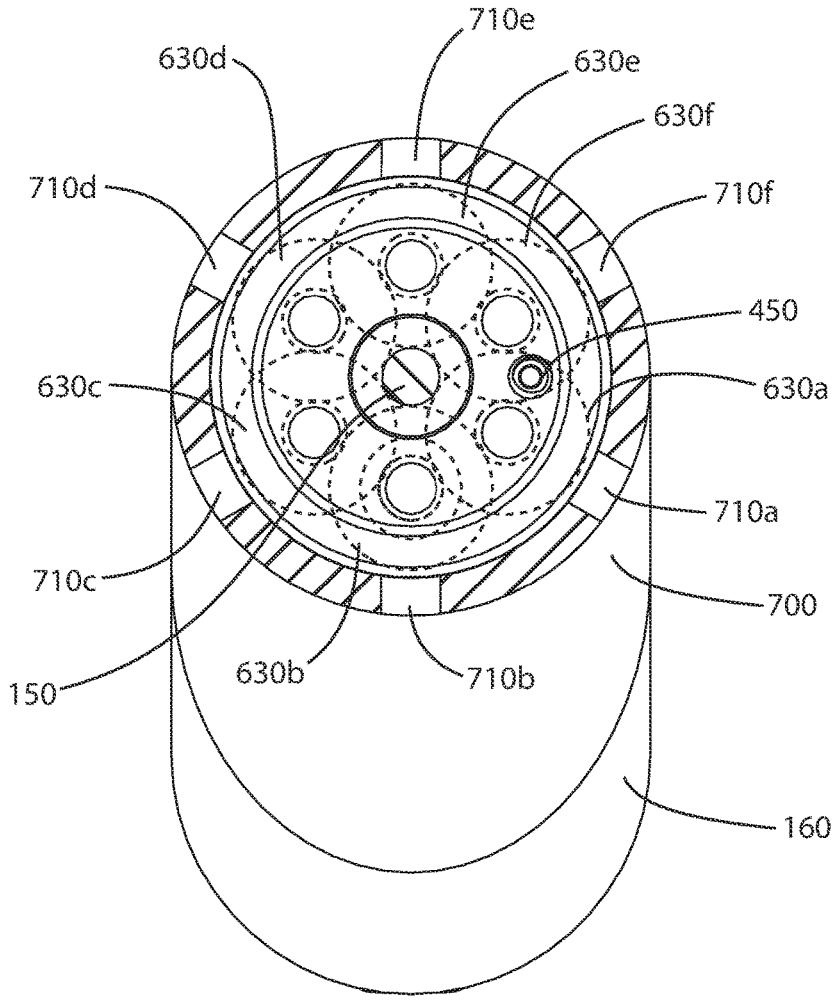

shows a perspective view of a diffuser for an inline pilot with a flame detection system in accordance with one or more aspects of the present invention;

FIG. 7A shows an angled top perspective view of a diffuser for an inline pilot, in accordance with one or more aspects of the present invention;

FIG. 7B shows a partial cutaway view from an angled bottom perspective of a diffuser for an inline pilot, in accordance with one or more aspects of the present invention;

FIG. 8 shows a side cutaway view of a diffuser for an inline pilot, in accordance with one or more aspects of the present invention;

FIG. 9 shows a side cutaway view from a perspective view of a nozzle-end of an inline pilot with a flame detection system in accordance with one or more aspects of the present invention;

FIG. 10 shows a side cutaway view of a nozzle-end of an inline pilot with a flame detection system with arrows to illustrate fuel and air paths in accordance with one or more aspects of the present invention;

FIG. 11 shows an angled top-end perspective of a nozzle-end of an ignited inline pilot with a flame detection system showing formation of flames, in accordance with one or more aspects of the present invention;

FIG. 12 shows a side perspective partial cutaway view of a nozzle-end of an ignited inline pilot with a flame detection system showing formation of flames, in accordance with one or more aspects of the present invention; and FIG. 13 shows a top-end perspective cutaway view of a nozzle-end of an ignited inline pilot with a flame detection system showing formation of flames, in accordance with one or more aspects of the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed so as to enable one skilled in the art to practice the present invention. The drawings and descriptions are exemplary of various aspects of the invention and are not intended to narrow the scope of the appended claims.

Turning now to FIGS. 1A-1B, 2, and 3, a novel naturally aspirated inline pilot assembly configured for flame detection is provided in accordance with one or more aspects of the present invention. The inline pilot may include a novel near field ionization method of flame detection in accordance with or more aspects of the present invention. The inline pilot assembly 100 can include a pilot nozzle assembly 400, a pilot spacer tube 160, pilot base hub 140, an axially disposed flame sensor electrode 150, a fuel mixer 120, and a fuel orifice 110. As can be seen from the Figures, the inline pilot may be assembled by connecting the fuel orifice 110 to the pilot mixer 120 at a fuel inlet end of the pilot mixer and connecting a fuel outlet end of the pilot mixer 120 to a fuel inlet port of the pilot base hub 140 so that fuel injected into the pilot mixer 120 from the fuel orifice 110 may flow from the pilot mixer 120 into the pilot base hub 160. The base hub 140 may accommodate the upstream mixer 120 and inline flame electrode 150 base connection via two threaded input ports 135, 155. The pilot mixer 120 fuel outlet may connect to a fuel inlet port of the pilot base hub 160 using threaded pipe nipple 125 that can be secured into a threaded outlet hole on the downstream side of the mixer 120 and connected to the base hub 140 at a fuel inlet port on the upstream side of the base hub 140 by threading the pipe nipple 125 into a threaded mixer mounting hole 135 which also acts as the fuel inlet port 135 for the base hub 140. The inline flame sensor electrode 150 may be coaxially disposed in the inline pilot assembly 100 by inserting the ignition or downstream end of flame electrode 150 into a threaded flame electrode mounting cavity 155 as shown in the Figures.

The pilot base hub 140 may be made of 303 Stainless Steel or any other suitable heat resistant, non-corrosive, conductive material. The pilot spacer tube 160 may be made of 304 Stainless Steel or any other suitable heat resistant, non-corrosive, conductive material.

The fuel orifice 110 may be connected to the mixer 120 adjacent to a fuel inlet port of the pilot mixer 120 by threading the fuel orifice 110 into a fuel orifice mounting hole 115 as seen in the Figures. In a preferred embodiment, the fuel orifice 110 for natural gas is configured with a fuel orifice hole having a number 66 drill hole size. In another preferred embodiment, the fuel orifice 110 for propane is configured with a fuel orifice hole having a number 72 drill hole size. Thus, a preferred orifice is #66 for natural gas and #72 for propane. A number 60 drill hole size may also be used for the fuel orifice 110. The fuel orifice 110 may include a sixty degree taper to the downstream orifice hole instead of a standard sixty-three degree taper. Also, the orifice face at the downstream orifice hole may have a reduced flat diameter of 0.090 inches compared to a standard 0.110 inch diameter face. The last thread on the fuel orifice is omitted to permit smoother air flow towards the mixer throat. This permits more efficient aspiration of air into the primary pilot mixer.

One of the advantages of the pilot assembly configuration of the present invention is that the orifice size for injection of fuel into the mixer 120 is not dependent on the fuel quality being used for the pilot. This permits different fuel qualities to be used without changing the fuel orifice size and without disrupting pilot functionality.

The inline pilot assembly 100 may be further assembled by connecting the pilot hub 140 to the pilot spacer tube 160 and connecting the pilot spacer tube 160 to the pilot nozzle assembly 400. The pilot spacer tube 160 may be threaded onto the downstream side of the pilot base hub 140 and the pilot nozzle assembly 400 may be threaded into the downstream end of the pilot spacer tube 160 to secure the pilot nozzle assembly 400 to the spacer tube 160.

As shown in FIGS. 4A-4C, 5, 6A-6C, 7A-7C, 8, and 9, the novel pilot nozzle assembly 400 may include a pilot nozzle 700, a diffuser 600, and a set screw 450 connected to the diffuser 600. The set screw may also be referred to as a spark screw. The diffuser 600 may have a threaded upstream end which permits the pilot nozzle assembly to connect to the downstream end of the pilot spacer tube 160. The upstream threaded end of the diffuser 600 may be threaded into the downstream end of the pilot spacer tube 160 to secure the diffuser 600 to the spacer tube 160. The set screw 450 may be threaded into a set screw hole 610 in the downstream side of the pilot diffuser 600. The pilot nozzle 700 may be placed over and fitted onto the downstream side of the pilot diffuser 600 as shown in the Figures. The pilot nozzle 700 may be welded to the diffuser 600 to secure it in place. The pilot nozzle 700 may be made of 316 Stainless Steel or any other suitable heat resistant, non-corrosive, conductive material. The pilot nozzle may also be referred to as a burner nozzle or nozzle. The pilot diffuser 600 may be made of 303 Stainless Steel or any other suitable heat resistant, non-corrosive, conductive material. The pilot nozzle 700, the diffuser 600, and the set screw 450 may together comprise a pilot nozzle assembly 400.

As described above, the naturally aspirated inline pilot 100 may be further assembled by inserting the flame sensor electrode 150 into and extending it through a flame rod securing cavity 155, wherein the threaded fittings of the flame sensor electrode 150 may be screwed into the threading of the flame rod securing cavity 155. The flame sensor electrode 150 may extend coaxially through the pilot spacer tube 140 and through a flame electrode hole 625 in the center of the pilot diffuser 600 to further extend coaxially into the pilot nozzle 700 as shown in the Figures. The flame sensor electrode 150 may include a ceramic insulating member 152 covering a portion of the conductive part of flame sensor electrode 150 that is disposed within the center flame electrode hole 625 of the diffuser 600 to insulate the conductive portion of flame sensor electrode 150 and prevent closing a circuit directly between the flame sensor electrode 150 and the pilot diffuser 600. The flame sensor electrode 150 may extend the entire length of the inline pilot assembly 100 from the upstream end of the base hub 140 through the spacer tube 160 and through the diffuser 600 into the nozzle assembly 400 and may easily be removed from the inline pilot assembly 100. The conductive rod portion of the flame sensor electrode 150 may be made of Kanthal or any other suitable heat resistant, non-corrosive, conductive material. As used herein, a flame sensor electrode may also be called a flame sensor, flame rod, flame sensor rod, or such other nomenclature as is commonly used in the industry.

A ground screw 145 may be used to connect a ground wire to the pilot base hub 140 so that a ground connection may be extended from the pilot nozzle 700 and the ground wire. The flame sensor electrode 150 may include a connection point at its base to receive an electrical plug or other electrical connection. A silicone boot 105 may be used to cover the electrical connection at the base of the flame sensor electrode to protect the connection point against unwanted contacts or arcing.

The naturally aspirated inline pilot 100 may be used to initiate combustion at a burner of a combustion application used for oil or gas processing. The inline pilot 100 may be operably connected to a burner management system having a control box for controlling the flow of fuel to the pilot and for controlling ignition of the pilot. Ignition of the pilot may be controlled by controlling electrical charge to the flame sensor electrode 150 to induce sparks between the conductive rod portion of the flame sensor electrode 150 and the set screw 450 internally to the pilot nozzle 700.

Fuel may be injected through the fuel orifice 110 into the pilot mixer 120, where the fuel mixes with air and subsequently flows through the inline pilot assembly by way of the pilot base hub 140 and the spacer tube 160 into the pilot nozzle assembly 400. The fuel may be ignited in the pilot nozzle assembly 400 by sparks created between the conductive rod portion of the flame sensor electrode 150 and the set screw 450 that is connected to the diffuser 600. During operation of the inline pilot of the present invention, mixed gas and air from the naturally aspirated mixer 120 pass into the base hub 140, then passes through the inside of the spacer tube 160 where the fuel/air mixture surrounds the flame electrode 150 within the spacer tube 160 as it travels to the connected pilot nozzle assembly 400.

Turning now to FIG. 10, the mixed fuel pathway as it travels from the pilot spacer tube 160 and into the pilot nozzle assembly 400 through the diffuser 600 is illustrated by the black arrows in FIG. 10. Also illustrated in FIG. 10 as represented by white arrows are air pathways for additional air inducted into the pilot nozzle 700 through specialized induction holes 710, which helps stabilize the pilot flame, as further described below. One of the unique aspects of the pilot nozzle assembly 100 of the present invention is that ignition of fuel/air mixture occurs as the fuel/air mixture moves along and around the circumferential surface of the flame electrode 150 as the fuel/air mixture travels longitudinally along the axis of the flame extrude 150.

As shown in FIGS. 4A-4C, 5, 6A-6C, 7A-7C, 8-9, and 10, the pilot diffuser 600 and the pilot nozzle 700 of the pilot nozzle assembly 400 include specialized holes for the passage of fuel and air that are configured in a unique arrangement that promotes and improves flame anchoring near the diffuser 600 and also deters forward migration of the pilot flame front. A set of axial holes axial holes 620*a*, 620*b*, 620*c*, 620*d*, 620*e*, 620*f* extending through the downstream end of the pilot diffuser 600 are disposed equidistance from each other in a circle around and parallel to the coaxially configured inline flame sensor rod 150. The fuel mixture traveling from the pilot spacer tube 160 passes from the spacer tube 160 into the pilot nozzle assembly through these axial holes 620*a*, 620*b*, 620*c*, 620*d*, 620*e*, 620*f* as shown in FIG. 10. Radial holes 615*a*, 615, b, 615*c*, 615*d*, 615*e*, 615*f* extending perpendicular to the longitudinal axis of the flame rod 150 are disposed through the lateral side 622 of the pilot diffuser 600 equidistance from each other around the circumference of the downstream end of the diffuser 600 as shown in the Figures. The radial holes 615*a*, 615, b, 615*c*, 615*d*, 615*e*, 615*f* of the pilot diffuser 600 are offset from and configured perpendicular to the axial holes 620*a*, 620*b*, 620*c*, 620*d*, 620*e*, 620*f* and each of the radial holes 615*a*, 615, b, 615*c*, 615*d*, 615*e*, 615*f* is disposed in the diffuser 600 about half the distance between two adjacent axial holes 620*a*, 620*b*, 620*c*, 620*d*, 620*e*, 620*f* as shown in the Figures. The fuel air mixture passes through the diffuser 600 through both the axial holes 620*a*, 620*b*, 620*c*, 620*d*, 620*e*, 620*f* radial holes 615*a*, 615, b, 615*c*, 615*d*, 615*e*, 615*f*. The axial diffuser holes 620*a*, 620*b*, 620*c*, 620*d*, 620*e*, 620*f* have a larger radius than the respective radial diffuser holes 615*a*, 615*b*, 615*c*, 615*d*, 615*e*, 615*f* to permit fuel to pass at a faster rate through the axial diffuser holes 620*a*, 620*b*, 620*c*, 620*d*, 620*e*, 620*f* than the rate at which fuel passes through the respective radial diffuser holes 615*a*, 615*b*, 615*c*, 615*d*, 615*e*, 615*f*.

As can also be seen in the Figures, in accordance with an aspect of the present invention, the pilot nozzle 700 may include a plurality of longitudinal series of radial nozzle holes 710, 720, 730. The pilot nozzle 700 may also include a plurality of nozzle end slits 735. Each of the nozzle end slits 735 may correspond and be in line with each of the longitudinal series of radial nozzle holes 710, 720, 730. Each longitudinal series of radial nozzle holes 710, 720, 730 may comprise three holes. In an aspect of the present invention, the radial nozzle hole 710 nearest the base in each longitudinal series of radial nozzle holes 710, 720, 730 is larger (e.g. has a larger radius) than the other two radial nozzle holes 720, 730 that are closer to the downstream end of the pilot nozzle 700.

When the pilot nozzle assembly 400 is assembled, the pilot nozzle 700 is configured so that each of the series of radial nozzle holes 710, 720, 730 is in line with one of the respective axial diffuser holes 620*a*, 620*b*, 620*c*, 620*d*, 620*e*, 620*f* as shown in the Figures. A channel 420 is formed between the surface of the lateral side 622 of the pilot diffuser 600 and the inner surface of the pilot nozzle 700 at the base of the pilot nozzle 700.

One of the advantages of the placement of the specialized holes of the pilot nozzle assembly with respect to each other is stabilization of the pilot flame.

During the ignition sequence as gas exits the pilot diffuser 600 through the specially designed radial diffuser holes 615*a*, 615, b, 615*c*, 615*d*, 615*e*, 615*f* and axial holes 620*a*, 620*b*, 620*c*, 620*d*, 620*e*, 620*f*, a spark is emitted from the flame rod to a dedicated spark post 450 disposed in the pilot diffuser internally at the base of the pilot nozzle 700, igniting the pilot flame. Internal ignition at the base of the pilot nozzle 700 permits reliable lighting under extreme environmental conditions, and ensures initial flame anchoring adjacent to the diffuser 600 in an inline configuration.

One of the unique aspects of the present invention is that the pilot nozzle assembly is configured so that ignition sparks are created between the flame rod 150 and the diffuser at the set screw disposed in the pilot diffuser 4 instead of between the flame rod and the pilot nozzle 700. This helps prevent loss of spark efficiency that can occur when nozzles exposed to harsh environments corrode. Also, the flame rod 150 does not need to be adjusted over time as the nozzle shroud 700 corrodes. It also reduces the materials and components needed to configure the pilot assembly 100. Another advantage of sparking to the diffuser 600 or set screw 450 at the diffuser 600 instead of the nozzle shroud 700 is that it helps initiate combustion near specially configured orifices in the diffuser 600 and at the base of the nozzle 700 which helps encourage flame anchoring within the pilot nozzle assembly 400 near the pilot diffuser 600. The internal configuration of sparking between the flame rod 150 and the diffuser 600 or set screw 450 connected to the diffuser 600 also eliminates the need for pilot brackets and bushings and reduces the need to reconfigure or adjust ionization rods and spark rods that may fall out after loosening from heat expansion. Also, in accordance with an aspect of the invention, the internalization of ignition wire protects ignition wire from flame and from melting out the cover of the wire.

Another advantage to the inline configuration of the present invention is that it eliminates the need for a wind cup due to the robust flame combusting inside of the nozzle assembly 400, to protect the flame from wind and does not need a thermocouple near the pilot to measure temperature to detect flame. Thus, the inline configuration allows for construction of a smaller less expensive pilot, which makes it more cost-effective to use higher-grade non-corrosive metals such as 316 Stainless Steel, 310 Stainless Steel, Hastelloy, Inconel, or other super alloys. The ability to use high-grade non-corrosive alloys reduces corrosion and increases the life and longevity of the pilot assembly.

In accordance with one or more other aspects of the present invention, the unique configuration of the pilot nozzle assembly and its components improves flame anchoring, and improves flame durability. The novel configuration also prevents the flame front from migrating forward by auto-educting additional air from outside the pilot nozzle 700 to promote combustion to permit flames in regions of greater aerodynamic strain, under less optimal combustion conditions, e.g., lower oxygen content of fuel mixture or reduced BTU value of fuel.

As shown in the Figures, the pilot nozzle 700 and the pilot diffuser 600 have a unique set of orifices which may function together to permit a unique and more robust method of flame detection, improved flame anchoring, a more robust and durable flame, and help prevent forward migration of the flame front. The unique auto aspirating design of the pilot nozzle assembly provides adaptable flame optimization for varying fuel types and fuel orifices.

In a preferred embodiment the number of axial diffuser holes 620*a*, 620*b*, 620*c*, 620*d*, 620*e*, 620*f* is six and the number of radial diffuser holes 615*a*, 615*b*, 615*c*, 615*d*, 615*e*, 615*f* is six. The six axial diffuser holes 620*a*, 620*b*, 620*c*, 620*d*, 620*e*, 620*f* are disposed equidistance from each other and correspond with a perimeter of the top-side of the downstream side of the diffuser 600. The six radial diffuser holes 615*a*, 615*b*, 615*c*, 615*d*, 615*e*, 615*f* are substantially perpendicular to the axial diffuser holes 620*a*, 620*b*, 620*c*, 620*d*, 620*e*, 620*f* and disposed approximately equidistance respectively between each of the six axial diffuser holes 620*a*, 620*b*, 620*c*, 620*d*, 620*e*, 620*f* as shown in the Figures. The radial diffuser holes 615*a*, 615*b*, 615*c*, 615*d*, 615*e*, 615*f* have a smaller diameter than the respective axial diffuser holes 620*a*, 620*b*, 620*c*, 620*d*, 620*e*, 620*f*. This configuration of holes helps stabilize and create a more robust pilot flame within the pilot nozzle assembly.

Additional structure comprising features of pilot nozzle assembly 400 components also help improve flame stability and anchoring of the pilot flame near the pilot diffuser 600 within the pilot nozzle 700. As can be seen in FIGS. 6A, 7B, 8, and 10, the inside upstream surface of the downstream end of the pilot diffuser 600 includes arched diffuser channels 617*a*, 617*b*, 617*c*, 617*d*, 617*e*, 617*f* to help direct fuel to the radial diffuser holes 615*a*, 615*b*, 615*c*, 615*d*, 615*e*, 615*f*. The arched diffuser channels 617*a*, 617*b*, 617*c*, 617*d*, 617*e*, 617*f* are configured perpendicular to the axial diffuser holes 620*a*, 620*b*, 620*c*, 620*d*, 620*e*, 620*f*.

The flame electrode hole 625 in the center of the pilot diffuser 600 is configured for receiving and securing the ceramic insulating region of the flame sensor electrode 150.

Figure 1A:
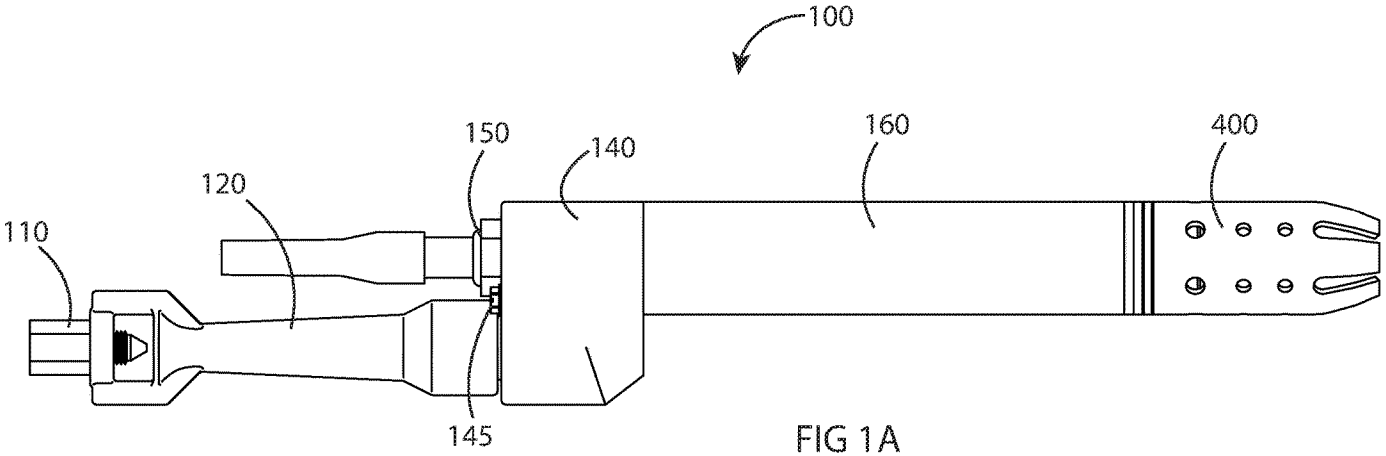
FIG. 1A shows a side view of an inline pilot with a flame detection system in accordance with one or more aspects of the present invention.
Figure 1B:
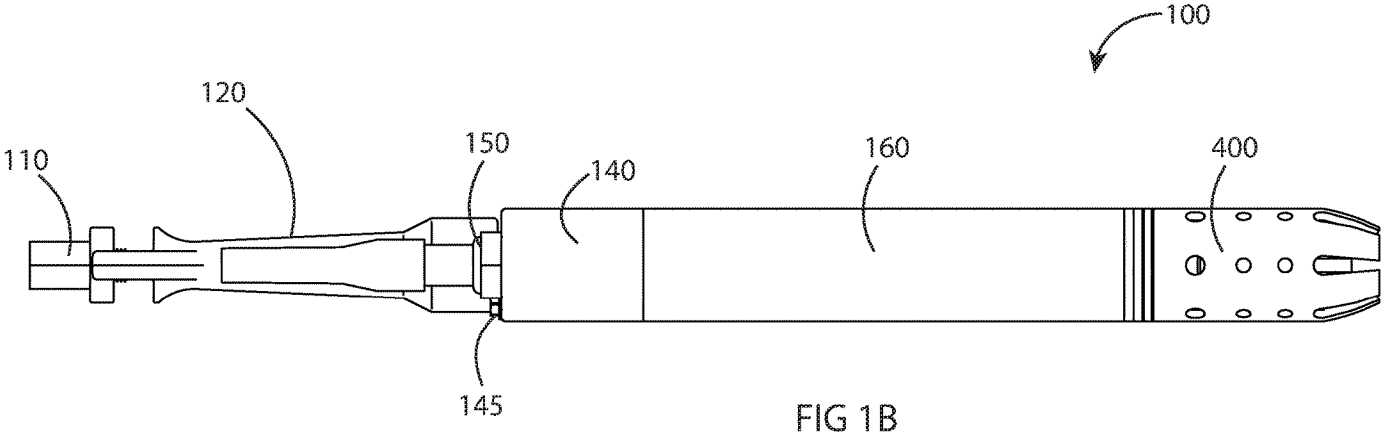
FIG. 1B shows a top view of an inline pilot with a flame detection system in accordance with one or more aspects of the present invention.
Figure 2:
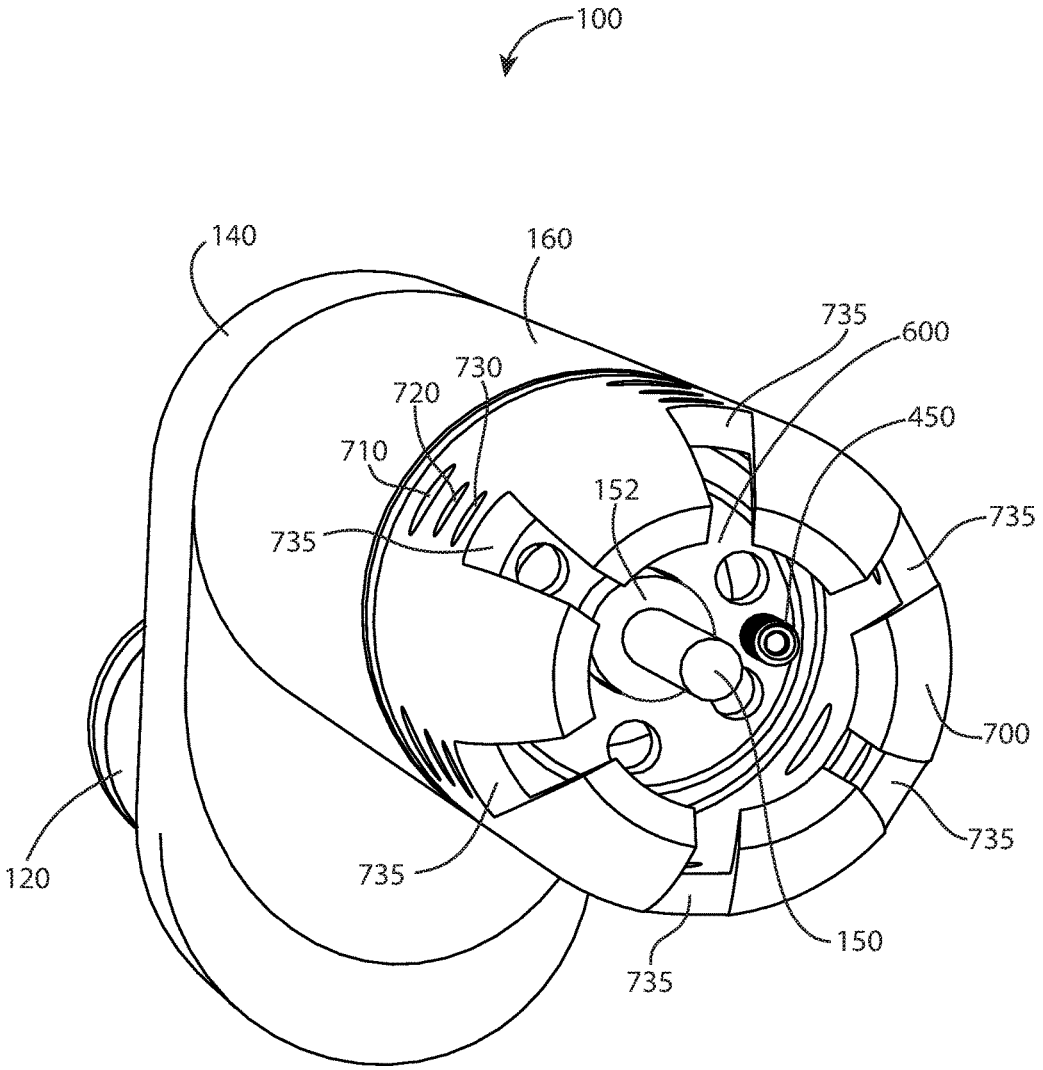
FIG. 2 shows an angled nozzle-end perspective view of an inline pilot with a flame detection system in accordance with one or more aspects of the present invention.
Figure 3:
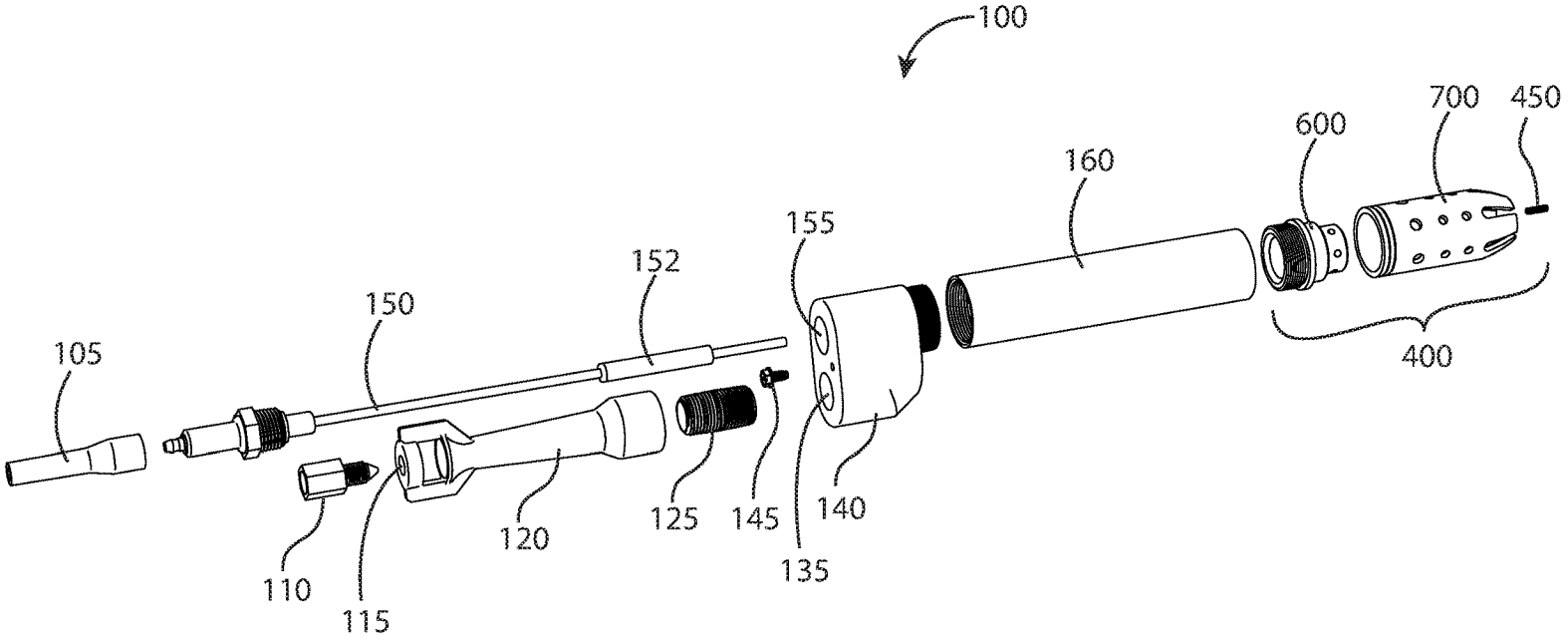
FIG. 3 shows an exploded view of an inline pilot with a flame detection system in accordance with one or more aspects of the present invention.
Figures 4A, 4B, 4C:
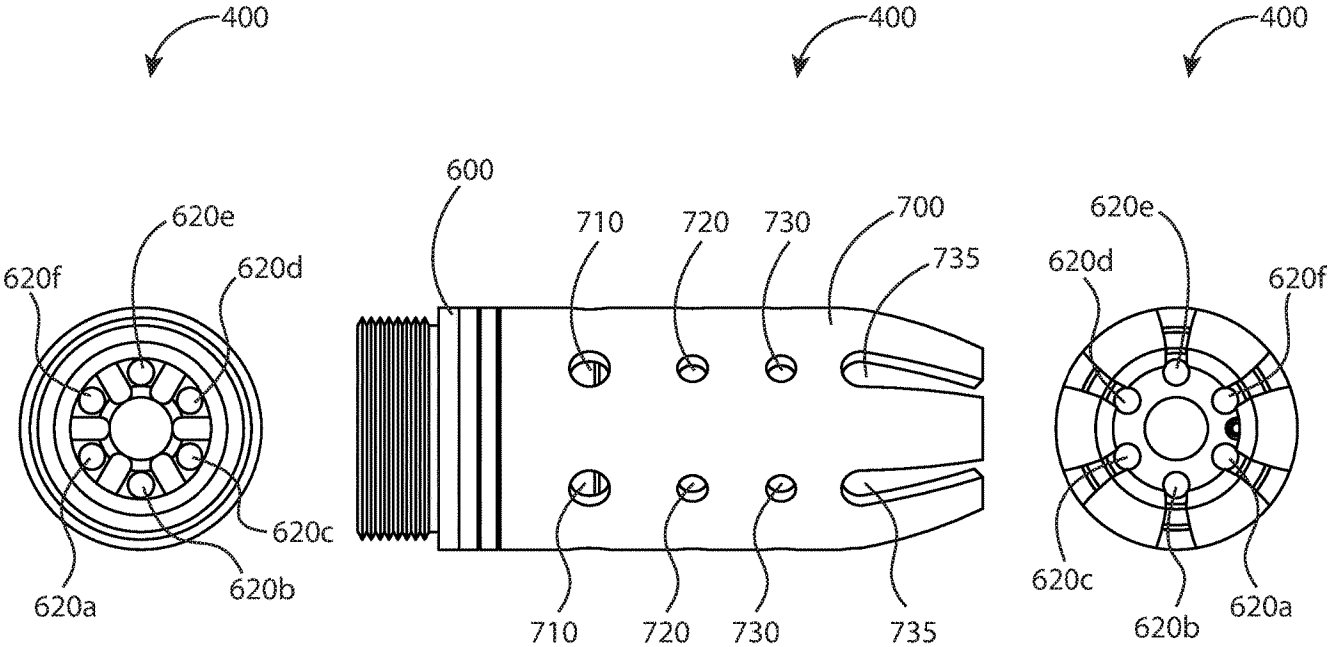
FIG. 4A shows a bottom end view a nozzle assembly for an inline pilot with a flame detection system from an upstream end of the nozzle assembly, in accordance with one or more aspects of the present invention.
FIG. 4B shows a side view of a nozzle assembly for an inline pilot with a flame detection system, in accordance with one or more aspects of the present invention.
FIG. 4C shows a top end view of a nozzle assembly for an inline pilot with a flame detection system from a downstream end of the nozzle assembly, in accordance with one or more aspects of the present invention.
Figure 5:
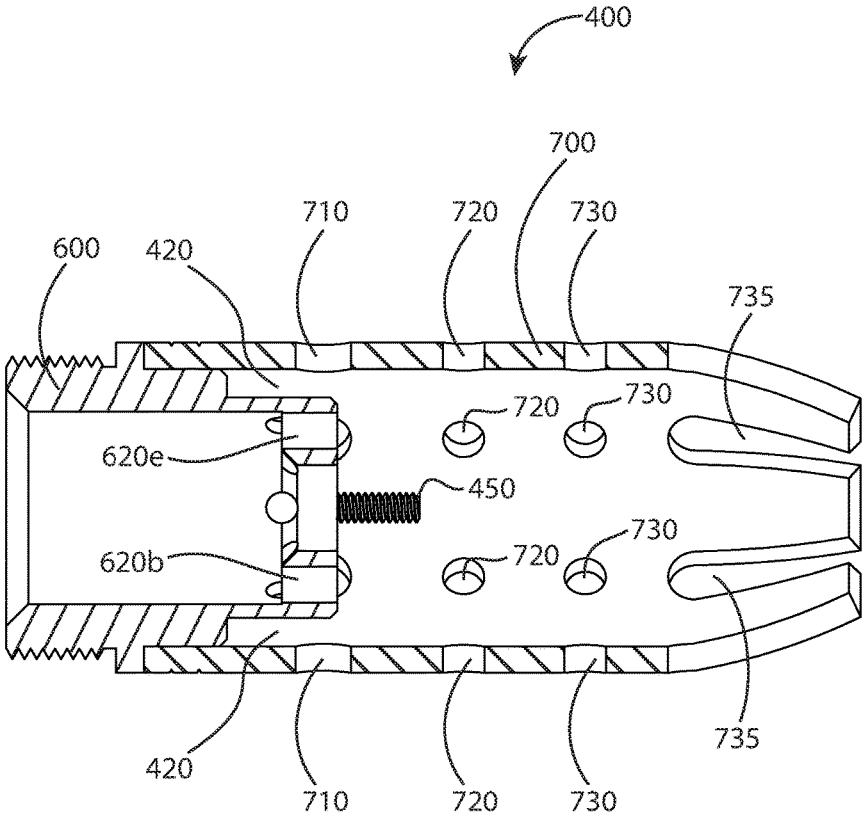
FIG. 5 shows a side cutaway view of a nozzle assembly for an inline pilot in accordance with one or more aspects of the present invention.
Figures 6A, 6B, 6C:
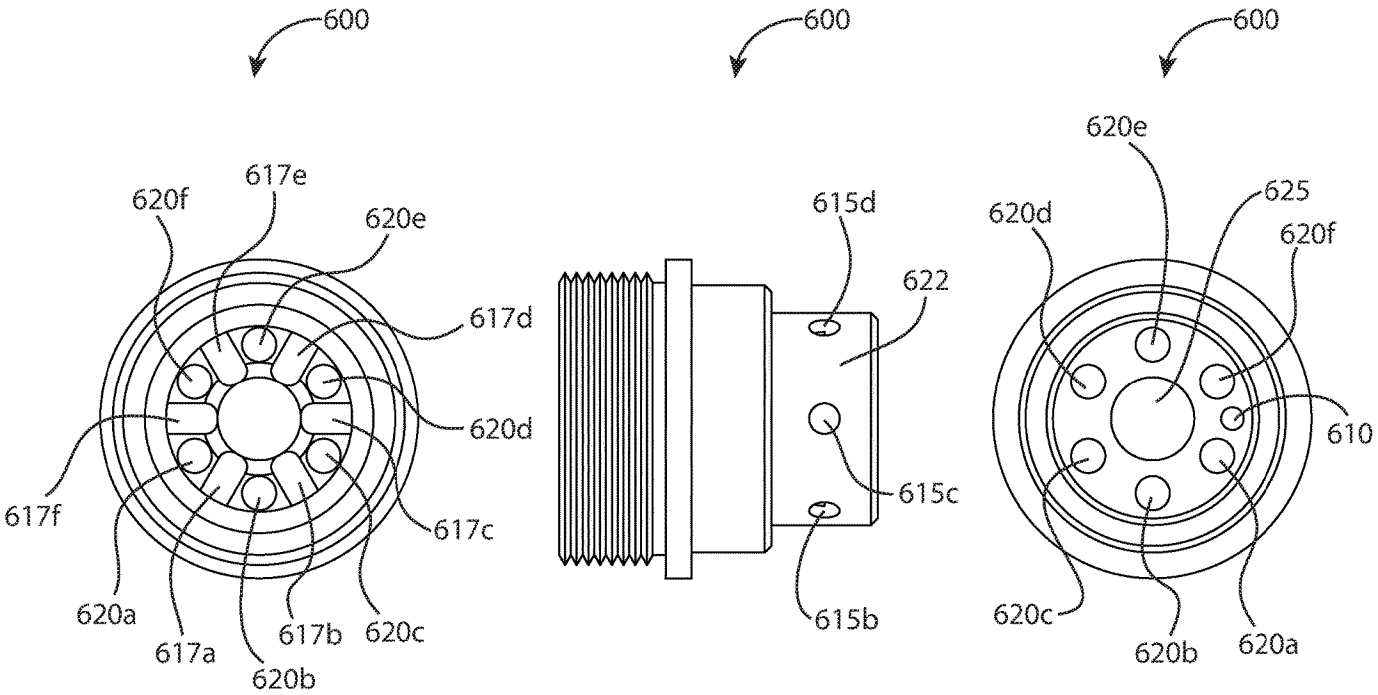
FIG. 6A shows a bottom end view of a diffuser for an inline pilot from an upstream end of the diffuser, in accordance with one or more aspects of the present invention.
FIG. 6B shows a side view of a diffuser for an inline pilot, in accordance with one or more aspects of the present invention.
FIG. 6C shows a top end view of a diffuser for an inline pilot from a downstream end of the diffuser, in accordance with one or more aspects of the present invention.

As shown in FIGS. 4C, 5, and 13, when the pilot nozzle assembly 400 is assembled, each axial diffuser hole 620*a*, 620*b*, 620*c*, 620*d*, 620*e*, 620*f* of the pilot diffuser 600 is rectilinear with and lines up with one of the longitudinal series of radial nozzle holes 710, 720, 730 and a respective nozzle end slit 735. In the assembled pilot nozzle assembly is also configured so that each of the radial diffuser holes 615*a*, 615*b*, 615*c*, 615*d*, 615*e*, 615*f* is positioned about equidistance between each of the radial nozzle holes 710 nearest the base of the pilot nozzle. Each of the radial nozzle holes 710 nearest the base of the pilot nozzle is disposed adjacent to a respective axial diffuser hole 620*a*, 620*b*, 620*c*, 620*d*, 620*e*, 620*f* that is in line with it.

As seen in the Figures, in another aspect of the present invention, a channel 420 is formed between the radial surface of the lateral side 622 of the pilot diffuser 600 and the inner surface of the pilot nozzle 700 at the base of the pilot nozzle 700. Each of the radial nozzle holes 710 nearest the base of the pilot nozzle is also disposed adjacent to the channel 420 formed between the radial surface of the lateral side 622 of the pilot diffuser 600 and the inner surface of the pilot nozzle 700 at the base of the pilot nozzle 700. The radial nozzle holes 710 nearest the base of the pilot nozzle 700 can act as induction holes 710 to induct air into the pilot nozzle assembly 400 and help prevent the pilot flame front from migrating forward away from the diffuser 600. The induction holes 710 are laterally disposed from the diffuser 600 so that the edge of the top surface of the diffuser 600 is about three quarters the distance of the top of the downstream edge of each of the induction holes 710 as can be seen in FIGS. 5 and 10. The induction holes 710 are laterally disposed from the diffuser 600 so that the top edges of the radial diffuser holes 615*a*, 615*b*, 615*c*, 615*d*, 615*e*, 615*f* extend adjacent to the lateral placement of the induction holes 710 as can be seen in FIGS. 5, 9, 10, and 12.

In another aspect of the present invention, each of the radial diffuser holes 615*a*, 615*b*, 615*c*, 615*d*, 615*e*, 615*f* faces and impinge on the inner surface of the pilot nozzle 700 shell between each of the radial nozzle holes 710 at the base of the nozzle 700. Similarly, each of the radial nozzle holes 710 in the base of the pilot nozzle 700 shell faces the radial wall of the later side 622 of the pilot diffuser between each of the radial diffuser holes 615*a*, 615*b*, 615*c*, 615*d*, 615*e*, 615*f*.

The unique configuration of the pilot nozzle assembly provides for a more robust and durable flame and an improved method of anchoring and maintaining a durable pilot flame. The orientation of the pilot diffuser holes and pilot nozzle holes permit negative pressure behind an active flame front to aspirate or educt additional makeup air to rear of flames through the radial nozzle holes 710 at the base of the nozzle 700 and into the channel 420 that is formed between the radial surface of the lateral side 622 of the pilot diffuser 600 and the inner surface of the pilot nozzle 700 at the base of the pilot nozzle 700. Air educed from outside the pilot nozzle 700 and into the pilot nozzle assembly 400 due to the negative pressure behind the flame front improves combustion and fortifies the flames, enabling the flame front to migrate back toward the diffuser 600 surface, promoting better flame anchoring and more defined flame shape for ionization. The larger rear radial nozzle holes 710 promote auto aspiration when combustion conditions demand. Air inducted into and through the radial nozzle holes 710 at the base of the nozzle 700 mixes with slower moving fuel that flows through the radial diffuser holes 615*a*, 615*b*, 615*c*, 615*d*, 615*e*, 615*f* and improves the mixture of air and gas for optimal combustion.

The radial diffuser holes 615*a*, 615*b*, 615*c*, 615*d*, 615*e*, 615*f* are smaller than the larger forward facing axial diffuser hole 620*a*, 620*b*, 620*c*, 620*d*, 620*e*, 620*f* and gas flowing through radial diffuser holes 615*a*, 615*b*, 615*c*, 615*d*, 615*e*, 615*f* is slowed as it impinges on the inside radial surface of the pilot nozzle and helps promote anchoring and combustion adjacent to the pilot diffuser 600. The special internal arched diffuser channels 617*a*, 617*b*, 617*c*, 617*d*, 617*e*, 617*f* inside of the rear of the diffuser help direct the flow of gas to the radial and axial facing holes, effecting optimized combustion. This unique configuration also stabilizes the pilot flame.

The pilot nozzle 700 is positioned on the pilot diffuser 600 such that each longitudinal series of radial nozzle holes 710, 720, 730 on the nozzle shell is located in-between radial diffuser holes 615*a*, 615*b*, 615*c*, 615*d*, 615*e*, 615*f*, permitting efficient aspiration effect. Each longitudinal series of radial nozzle holes 710, 720, 730 and corresponding nozzle end slit 735 is also positioned in line with respective axial diffuser hole 620*a*, 620*b*, 620*c*, 620*d*, 620*e*, 620*f*, permitting efficient rectilinear aspiration adjacent to each of a plurality of tubular-like flames combusting within the pilot nozzle assembly.

The unique configuration of the pilot nozzle assembly provides several advantages. One of the advantages of the pilot assembly of the present invention is that it permits emission of a useable flame at a wider range of fuel pressure. Recommended pilot operating pressure is from about 4 psi to about 6 psi. Pilot systems currently available in the industry typically have a poor turndown ratio. One of the advantages of the pilot assembly of the present invention is that it has a high turndown ratio. The pilot nozzle configuration allows emission of a robust usable flame when fuel pressure is between about 2 psi and about 25 psi.

Another advantage of the unique configuration of the nozzle assembly is that is highly responsive to changes in BTU, richness in gas mixture, and gas flow velocity all of which may weaken flame tolerance to aerodynamic strain. A weakened flame may extinguish due to turbulence and strain from the incoming flow of mixed gas sufficient to prevent combustion or the flame front may migrate forward away from the turbulence. Several factors may contribute to weakened flame and flame front migration away from the diffuser, such as use of too large of a fuel orifice; the feed gas having lower BTU content; or the mixed gas velocity is too high for the given conditions, e.g., higher operating gas pressure. When operating a pilot in the field, one or more of the above conditions may affect normal pilot performance and cause the flame front to migrate forward weakening the flame.

An advantage of the unique nozzle assembly of the present invention is that it encourages improved aspiration of air in response to these conditions as flame conditions demand and invites the flame front closer the diffuser 600 for improved anchoring. This is important because the use of a center flame sensor electrode for ignition and effective flame detection are highly dependent upon flame stability and position. Under poor flame conditions, a flame demands more air than it gets from the mixer which encourages the flame front to burn farther away from the diffuser. When this happens, the hole configuration in the pilot nozzle assembly 400 encourages makeup air to be aspirated into the base of the nozzle, due to negative pressure created behind the flame. This stabilizes the flames better, encouraging flame anchoring at the diffuser 600 and more robust flame detection. Importantly, it allows a wider operating range of feed gas pressure and fuel orifice size.

The nozzle assembly 400 may operate as a system, with components that work synergistically together to affect a successful burn. The pilot diffuser 600 properly distributes and shapes the mixed gas for good combustion. After exhaustive empirical testing, an optimal arrangement and size of holes were determined. Radial holes 615*a*, 615*b*, 615*c*, 615*d*, 615*e*, 615*f* are positioned and orientated to properly encourage flame anchoring, and introduce a portion of the gas mixture at lower downstream velocities than the forward facing exit or axial holes 620*a*, 620*b*, 620*c*, 620*d*, 620*e*, 620*f* in the diffuser 600. The orientation of the radial holes 615*a*, 615*b*, 615*c*, 615*d*, 615*e*, 615*f* should not be in line with the forward facing axial holes 620*a*, 620*b*, 620*c*, 620*d*, 620*e*, 620*f* and should be placed behind them.

Referring now to FIGS. 11 through 13, a novel method of flame detection in accordance in one or more aspects of the present invention is provided. As seen in the Figures, when fuel passing through the inline pilot assembly 100 is ignited in the nozzle assembly 400, the nozzle assembly produces a nested, tightly packed and well organized pilot flame 640 comprising six separate flames 630*a*, 630*b*, 630*c*, 630*d*, 630*e*, 630*f* that combine into one flame 640 at the exit of the pilot nozzle 700. These well-defined flames 630*a*, 630*b*,

630*c*, 630*d*, 630*e*, 630*f* flow in a laminar fashion past the internal flame rod 150, permitting excellent flame sensing via ionization. Exit flame characteristics can be adjusted by increasing or decreasing the swage angle of the nozzle petals to create the desired flame pattern.

As seen by the cross-section of each flame 630*a*, 630*b*, 630*c*, 630*d*, 630*e*, 630*f* in FIG. 13, each flame 630*a*, 630*b*, 630*c*, 630*d*, 630*e*, 630*f* includes a flame core. The flame core may have an intense blue periphery on the outer surface. The well-defined flames contain a rich source of conducting ions, including around their shells or peripheries. The stability of the individual well-defined flames provide for stable overlap of the ion rich shells of the individual flames to improve conductivity by the flame ions and improve flame detection and rectification.

As shown in the Figures, the flames 630*a*, 630*b*, 630*c*, 630*d*, 630*e*, 630*f* may be configured around the perimeter of the flame sensor electrode 150 within the pilot nozzle 700 so that the ion rich shell of each flame contacts the flame sensor electrode 150 on one side of the flame and the inside surface of the pilot nozzle 700 on the opposite side of the flame. The pilot nozzle 700 is grounded so that current may be passed from the flame sensor electrode 150 through the ionized gas in the flame to return the AC waveform to the ground. The alternate signal path from pilot nozzle shell to flame rod is sufficiently attenuated due to the small surface area of the flame rod compared to the nozzle shell. Flames may be detected and monitored by detecting closed circuits and measuring voltage shifts.

Configuration of each of the flames burning longitudinally within the pilot nozzle 700 wherein contact between the inline flame sensor electrode 150 and the ion rich shells is maximized improves flame detection sensitivity and creates a more robust flame.

In a preferred embodiment, the plurality of parallel tubular-shaped flames combusting parallel and around the coaxially disposed flame sensor electrode 150 consists of six longitudinal flames 630*a*, 630*b*, 630*c*, 630*d*, 630*e*, 630*f*. Empirical trials demonstrate surprisingly more effective flame detection using six flames over a smaller or larger number of independent flames.

One of the advantages to flame detection using a plurality of flames around a center flame sensor electrode is that it provides greater flame detection reliability under adverse environmental conditions, such as icing or clogging. It also allows flame detection over a wider range of fuel pressure. When flames are weak or less robust, standard flame detection systems may shut off a pilot if it cannot detect a flame. An advantage of the flame detection system of the present invention is that it operates or may permit the pilot to operate below about 0.5 psi and as high as about 30 psi. Another advantage of the unique configuration of a plurality of flames is redundancy wherein one flame helps fortify adjacent flames.

There is thus disclosed an improved naturally aspirated pilot assembly, apparatus, components, method of flame detection, and method of maintaining a robust durable flame. It will be appreciated that numerous changes may be made to the present invention without departing from the scope of the claims.

What is claimed is:

1. An inline pilot assembly comprising:

a fuel orifice;

a fuel mixer;

a base hub;

a spacer tube;

a nozzle assembly having a diffuser and a burner nozzle for maintaining combustion, wherein the diffuser has a central opening and is configured for receiving a flame rod through the central opening in the diffuser; and a flame rod;

wherein the fuel orifice is fluidly connected the fuel mixer at an upstream end of the fuel mixer, the fuel mixer is fluidly connected to the base hub at an upstream end of the base hub, the base hub is fluidly connected to the spacer tube at an upstream end of the spacer tube, and the spacer tube is fluidly connected to the upstream end of the nozzle assembly;

wherein the flame rod is disposed internally within the spacer tube and extends coaxially within at least a portion of a length of the spacer tube and also extends coaxially through the central opening in the diffuser and into the nozzle assembly; and wherein the diffuser is configured for directing fuel into the burner nozzle adjacent to the flame rod.

2. The inline pilot assembly of claim 1, wherein the burner nozzle has a ground connection.

3. The inline pilot assembly of claim 1, further comprising a set screw connected to the diffuser and disposed on the diffuser internally to the burner nozzle.

4. The inline pilot assembly of claim 3, wherein the set screw is configured to permit formation of a spark between the set screw and a conductive region of the flame rod.

5. The inline pilot assembly of claim 1, wherein the diffuser has a plurality of radial holes disposed in a radial wall of the diffuser.

6. The inline pilot assembly of claim 5, wherein the diffuser has a plurality of axial holes disposed in a downstream end of the diffuser adjacent a perimeter of the downstream end of the diffuser.

7. The inline pilot assembly of claim 6, wherein one or more of plurality of axial holes in the diffuser is larger than one or more of the plurality of radial holes in the diffuser.

8. The inline pilot assembly of claim 7, wherein each of the plurality of the axial holes in the diffuser is disposed equidistance from each of the adjacent axial holes in the diffuser.

9. The inline pilot assembly of claim 7, wherein each of the plurality of radial holes in the diffuser is disposed equidistance from each of the adjacent radial holes in the diffuser.

10. The inline pilot assembly of claim 7, wherein the burner nozzle includes a plurality of a longitudinal series of holes disposed radially in the burner nozzle, wherein a first hole of each longitudinal series of holes is disposed near a base end of the burner nozzle and is larger than downstream holes in the same longitudinal series of holes;

wherein a radial channel is formed between the outer radial wall of the diffuser and an inner radial surface of the burner nozzle;

wherein one or more of the plurality of radial holes in the diffuser is disposed in the diffuser at a position that is not in line with one of the plurality of axial holes in the diffuser; and wherein the first hole of each of the plurality of longitudinal series of holes, said first hole being disposed near a base end of the burner nozzle, faces an area of the radial wall of the diffuser between two of the radial holes in the pilot diffuser.

11. A pilot nozzle assembly for use with a coaxially configured inline pilot comprising:

a pilot nozzle, wherein the pilot nozzle includes a plurality of a longitudinal series of holes disposed radially in the pilot nozzle, wherein a first hole of each longitudinal series of holes is disposed near a base end of the pilot nozzle and is larger than downstream holes in the same longitudinal series of holes;

a pilot diffuser disposed in the base end of the pilot nozzle, wherein the pilot diffuser has a central opening for receiving a flame rod;

wherein a radial channel is formed between an outer radial wall of the pilot diffuser and an inner radial surface of the pilot nozzle;

a plurality of radial holes disposed in the radial wall of the pilot diffuser adjacent to the radial channel;

a plurality of axial holes disposed in a downstream end of the pilot diffuser adjacent a perimeter of the downstream end of the pilot diffuser;

wherein the axial holes in the pilot diffuser are larger than the radial holes in the pilot diffuser and the radial holes in the pilot diffuser are not in line with the axial holes in the pilot diffuser; and wherein each first hole of each longitudinal series of holes in the pilot nozzle face an area of the radial wall of the pilot diffuser between two of the radial holes in the pilot diffuser.

12. The pilot nozzle assembly of claim 11, wherein a top edge of the downstream end of the pilot diffuser extends into the pilot nozzle to a distance fixed between a first upstream side an opening forming the first hole of the longitudinal series of holes disposed near the base end of the pilot nozzle and a second downstream side of the opening forming the first hole of the longitudinal series of holes disposed near the base end of the pilot nozzle.

13. The pilot nozzle assembly of claim 12, wherein the top edge of the downstream end of the pilot diffuser extends into the pilot nozzle to a distance that is about ¾ of the distance to the second downstream side of the opening forming the first hole of the longitudinal series of holes disposed near the base end of the pilot nozzle.

14. A pilot nozzle assembly of claim 12, wherein one or more of the plurality of radial holes in the pilot diffuser are disposed within the radial channel between two of the first holes of the plurality of longitudinal series of holes that are disposed in the inner radial surface of the pilot nozzle adjacent to said one or more of the plurality of radial holes.

* * * * *